United States Patent [19]

Bischoff, Jr.

[11] 4,118,055

[45] Oct. 3, 1978

[54] TURNING MECHANISM

[76] Inventor: Robert F. Bischoff, Jr., 30 Fairmount Ave., Morristown, N.J. 07960

[21] Appl. No.: 628,138

[22] Filed: Nov. 3, 1975

[51] Int. Cl.[2] ..... E05C 1/12

[52] U.S. Cl. ..... 292/165

[58] Field of Search ..... 292/173, 244, 245, 165, 292/169.17, 169, 169.14; 70/145, 467, 468, 471, 473, 477, 483, 489, 380

[56] References Cited

U.S. PATENT DOCUMENTS

| | | | |
|---|---|---|---|
| 2,544,959 | 3/1951 | Hillgren | 292/169.17 |
| 2,726,891 | 12/1955 | Gresham et al. | 292/169.17 |
| 2,988,389 | 6/1961 | Wilson | 292/165 |

*Primary Examiner*—Paul R. Gilliam
*Assistant Examiner*—Kenneth J. Dorner

[57] ABSTRACT

This invention relates to a door lock, and particularly to the turning mechanism which activates movement of the latch bolt mechanism of the door lock.

2 Claims, 12 Drawing Figures

TURNING MECHANISM

This invention is an improvement in the turning mechanism of a door lock. Though this turning mechanism can be adapted to a multiple of latch bolt mechanisms, and also to other types of door locks, this invention can be used to special advantage in my co-pending application which is entitled "Latch Bolt Mechanism."

An object of this invention is to generally improve the construction and the operation of a door lock by providing a turning mechanism so constructed that its retractor, which operates the latch bolt mechanism, fills the interior center portion and beyond of the said turning mechanism, and the spindle and the locking element rod of this turning mechanism occupy off-center positions.

Referring to the drawings.

Figure 1:
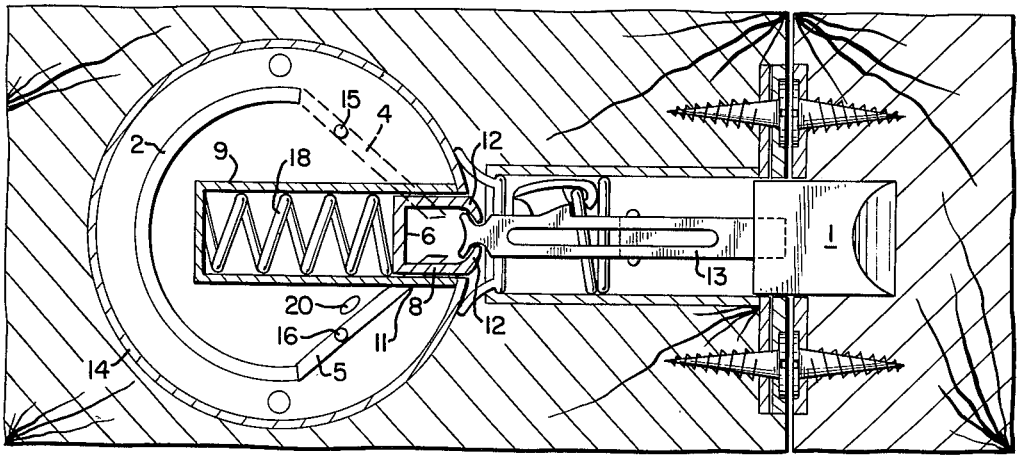
FIG. 1 is a cross-sectional side view of the lock mechanism showing the turning mechanism in a non-turned position.
Figure 2:
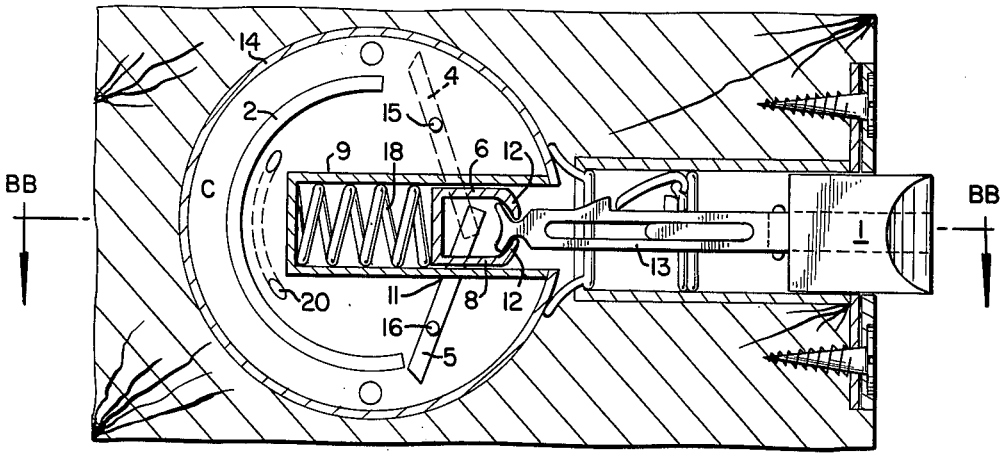
FIG. 2 shows the turning mechanism in a semi-turned position, taken through A—A of FIG. 4.
Figure 3:
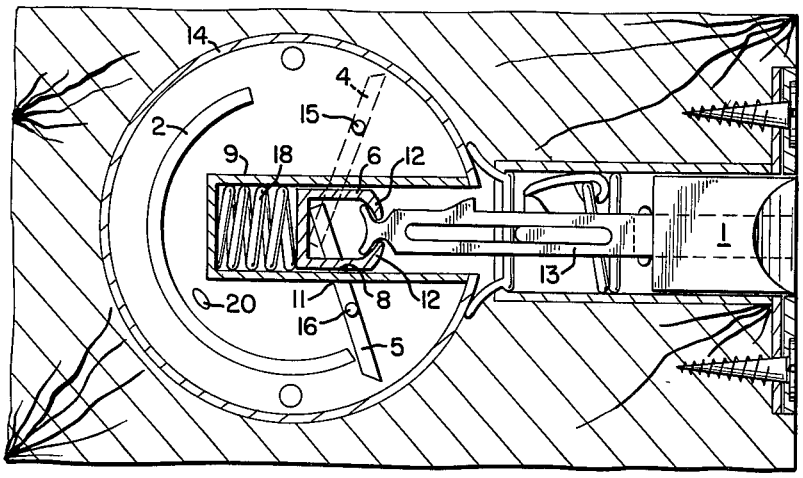
FIG. 3 shows the turning mechanism in a fully turned position, when turned counterclockwise.

In FIGS. 1–3 are indicated the principal positions the turning mechanism assumes during proper functioning of the lock. Though these cross-sectional views would not normally, therefore, show lever 4, this lever has been indicated in FIGS. 1–3 by a broken line for clarity regarding the explanation of said lever's function.

Figure 4:
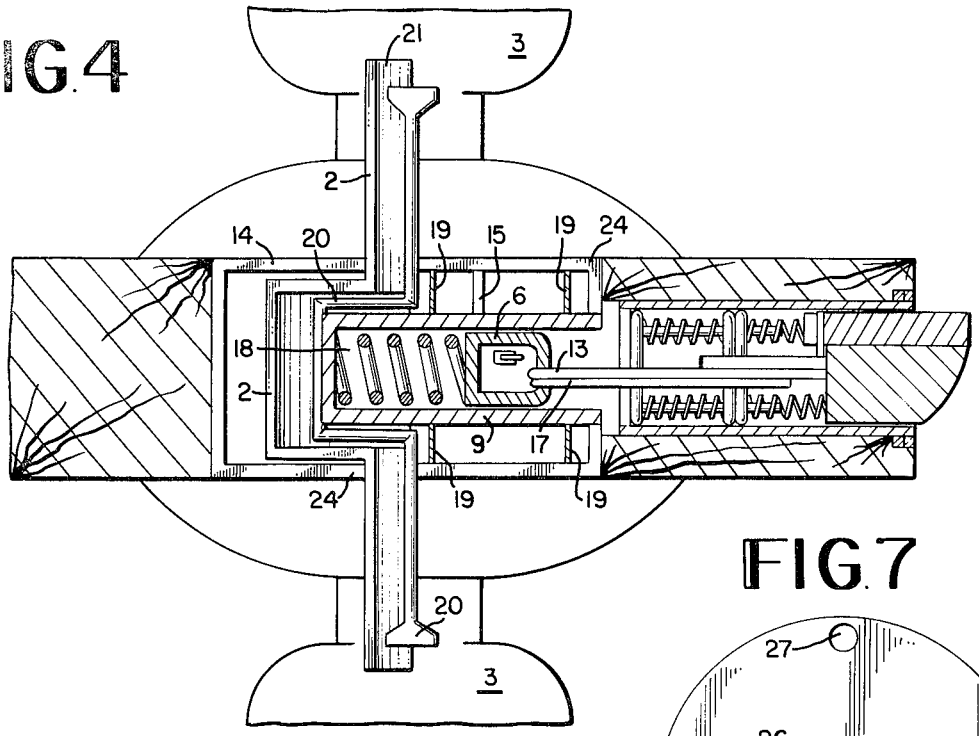
FIG. 4 shows a cross-sectional top view of the lock mechanism taken through B—B of FIG. 2.

In FIG. 1, the turning mechanism is depicted in a relaxed or non-turned position. The principal function of the turning mechanism is to activate the latch bolt mechanism. Such activation moves the latch bolt 1 in a horizontal left to right (or vice-versa) direction, as depicted in FIGS. 1–3. Referring to these Figures, the turning handle spindle 2 turns with the same comparative ratio as does the handle (FIG. 4,3). The said spindle 2, when activated, can turn in either a clockwise or a counterclockwise direction with equal facility. When the spindle 2 turns in either direction, said spindle will force pressure upon either lever 4 or lever 5, depending upon the direction in which the handle is turned. Therefore, when said spindle is turned in a clockwise direction, lever 4 will be activated; if turned in a counterclockwise direction, lever 5 will be activated.

In FIGS. 1–3, the said spindle 2 is turning in a counterclockwise direction, thereby applying pressure against lever 5. The fact that each of the said levers moves in a similar manner when the handle is turned either clockwise or counterclockwise, is due to the fact that the ends of said levers which do not contact the spindle are engaged in the retractor 6. This engagement occurs because the said levers 4,5 are extended through the openings 7,8 in the retractor 6, which said openings permit the levers to be engaged at all times with the retractor 6.

These said openings 7,8 in the retractor 6 allow the levers 4,5 to function without hesitation when the turning mechanism is activated. Since these levers 4,5 are on opposite sides of the retractor 6, when said levers are rotated, the ends of the levers which are engaged within the retractor do not make contact with each other.

Also contained within the retractor cylinder 9 are openings 10,11 or slots, which said openings or slots correspond to the openings 7,8 in the retractor 6. The openings 10,11 in the cylinder of the retractor 9 have the purpose of permitting the levers to move through their space.

The retractor 6 has two grips 12, which said grips 12 enclose the latch bolt bar 13 and cause movement of the latch bolt mechanism relative to activation of the turning mechanism retractor 6. The levers 4,5 are identical in design and function, with their only difference being their location in the turning mechanism.

The levers 4,5 are fastened to the turning mechanism housing 14 with the upper lever 4 being fastened to the housing 14 on the upper side, and the lower lever 5 being fastened to the opposite side of the said housing.

These levers pivot at the point where the pivoting bars 15,16 are fastened to the housing. Each of these levers 4,5 has a different length, with the longer section of the lever being that part which goes into contact with the retractor 6, and the shorter section that part which goes into contact with the spindle 2. These levers have different lengths for two reasons: One, to give to the turning mechanism and to the latch bolt mechanism a 1:2 ratio, where "1" equals the turning mechanism, and "2" equals the latch bolt mechanism. Because of this ratio, the movement of the turning mechanism is one-half that of the latch bolt mechanism, when the turning mechanism is turned. The second reason for this differentiation in lengths of the levers, is to make the turning mechanism economical in structure with reference to space.

In FIG. 4, the retractor 6 engulfs and grips the ends of the latch bolt mechanism bar 13 and the latch bolt guide 17. The retractor 6 rides back and forth inside the retractor cylinder 9, which said cylinder also encloses the cylinder spring 18. The cylinder 9 is fastened to the turning mechanism housing 14 at four points 19. The plates of the turning mechanism housing are shown in FIG. 4 as 24. The said enclosed cylinder spring 18 always keeps the retractor 6 in a pressurized state toward the latch bolt mechanism.

Figure 6:
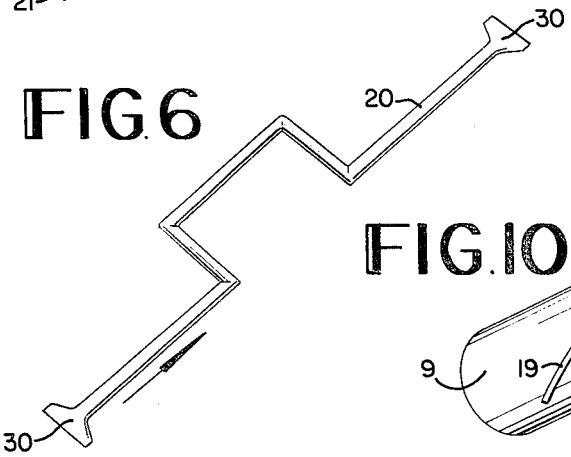
FIG. 6 is a perspective view of the locking element rod.

The lock mechanism which can be used in this lock is the type which is contained within the turning handles 3. This mechanism is such that one handle contains a key insertion mechanism, and the other handle contains a dial. This said dial, usually on the interior handle, works in conjunction with the lock mechanism. The two handles function as a locking mechanism working together with a locking element rod 20, which said locking element rod 20 runs between the two handles. FIG. 6 shows the construction of this locking element rod.

As previously stated, the center of the turning mechanism is occupied by the retractor 6. For this reason, the locking element rod 20 is shaped in its center portion with the right angle section, which said section prevents the locking element rod 20 from occupying the center area of the turning mechanism which the retractor 6 occupies. As depicted in FIG. 4, the said rod 20 does not contact the retractor cylinder 9.

The locking element rod 20 assumes two positions in the turning mechanism-either an "on" position or an "off" position. The "off" position is illustrated in FIGS. 2, 3, and 4. This said position of the locking element rod 20 is obtained when the locking mechanism is in an unlocked position.

The second, or "on" position of this said rod 20 is illustrated in FIG. 1, which position of the locking element rod 20 in this figure, is the position in which said rod dogs the lock, and also the position in which said rod is in its locked position. In this position of the locking element rod 20 shown in FIG. 1, the said rod both locks and dogs the locking mechanism, because when this said rod is in this position, the latch bolt cannot slide back so that the door cannot be jimmied.

FIG. 1 depicts the only situation of the lock in which the locking element rod 20 can obtain this position, if the turning mechanism construction is such that such a dog has been desired within said mechanism.

However, it may be that this dogging is not desired. If this is the case, all that is necessary to construct the locking element rod 20 so that said rod does not dog, is to construct this rod as it would appear when viewing FIG. 6 in the direction of the arrow, standing back from the said figure, if each end 30 of the said rod were rotated 90° counterclockwise.

This new construction of the said rod, when installed into proper position within the turning mechanism, will assume the moving position shown by the dotted line "C" in FIG. 2.

Figure 5:
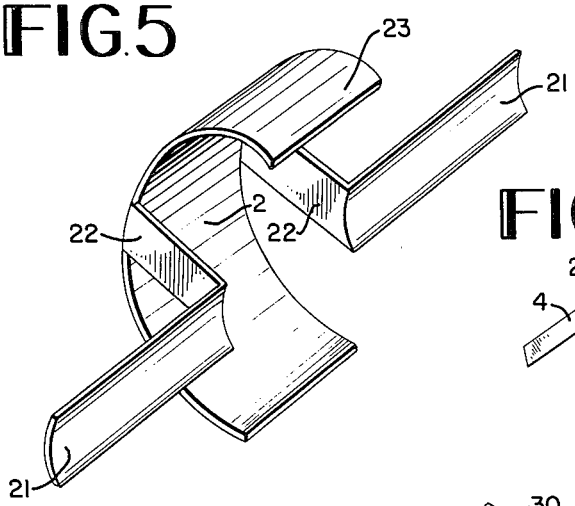
FIG. 5 is a perspective view of the spindle.

The spindle 2 shown in FIG. 5 illustrates the construction and style of this said spindle. The general style is similar to that of the locking element rod. As stated for the locking element rod, the reason that a portion of this said spindle 2 is off-center is because the retractor occupies the center of the turning mechanism.

The two end portions 21 of the said spindle 2, are partly arched in shape so that they fit properly in the turning handles. In the handles, the female receiver is shaped to receive said ends 21. The right angle plates 22 join these partly arched portions with the greatly arched section 23. FIG. 4 shows the shape or construction of the spindle 2 in relation to the turning mechanism as a whole. The greatly arched section (FIG. 5, 23) of the spindle is so designed that this said section is able to contact either lever (FIGS. 1-3, 4, 5) when the handles move this said spindle.

Figure 7:
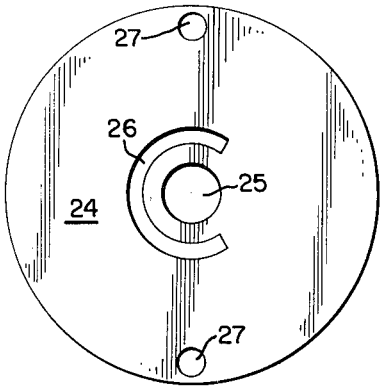
FIG. 7 is a side view of one side plate of the turning mechanism housing.

FIG. 7 illustrates a side view of one plate 24 of the turning mechanism housing. The center opening 25 is that opening which permits the locking element rod to pass through the said housing.

The approximate three-fourths circular shape 26 in the housing plate 24 is the opening through which the spindle functions. The holes 27 are to permit screwing the lock mechanism together. The other side of the turning mechanism housing is constructed in a similar way.

FIG. 8 shows two views of one of the levers 4. The lever 4 is constructed of durable material which can tolerate the use to which the levers are put in this turning mechanism.

Figure 8A:
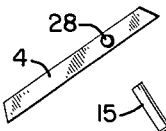
FIGS. 8A and 8B are two perspective views of one of the levers.

FIG. 8A shows a side view of the lever 4, depicting the opening 28 through which the pivoting bar (FIG. 8B, 15) passes and around which the lever moves.

Figure 8B:
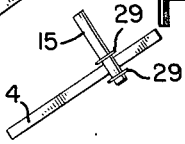

FIG. 8B is a top view of the lever 4, which said lever rotates on the pivoting bar 15. The said lever has an opening through it (FIG. 8A, 28) through which the said bar 15 passes. On each side of the pivoting bar 15 there are grooves into which fit the locking washers 29.

Figure 9:
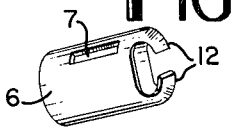
FIG. 9 is a perspective view of the retractor.

FIG. 9 shows a perspective view of the retractor. This said retractor 6 is circular in shape so as to simulate the shape of the interior of the retractor cylinder (FIG. 10), since said retractor moves back and forth inside the said cylinder. The gripping elements 12 of the retractor 6 attach the turning mechanism to the latch bolt mechanism. The opening 7 in the said retractor is for one of the levers to be inserted therein. It is understood that the construction of the opposite side of the retractor is similar.

Figure 10:
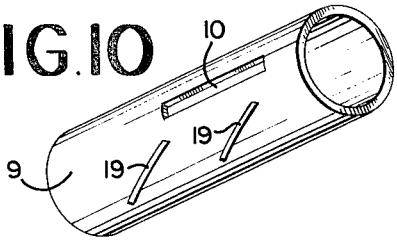
FIG. 10 is a perspective view of the retractor cylinder.

FIG. 10 is a perspective view of the retractor cylinder 9 of the turning mechanism. This said cylinder 9 is attached to the turning mechanism housing by four fasteners 19, two on each side of the said cylinder. The opening 10 is that section through which the levers move back and forth in the retractor. The opposite side of the cylinder is constructed similarly.

Figure 11:
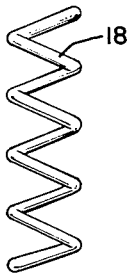
FIG. 11 is a perspective view of the retractor cylinder spring.

FIG. 11 is a perspective view of the cylinder spring 18, which said spring applies pressure to the retractor, so that the retractor, in turn, applies pressure to the latch bolt mechanism.

Although but a single embodiment of my invention has been illustrated and described, it is apparent to those skilled in the art, that various changes and modifications may be made therein without departing from the spirit of the invention or from the scope of the appended claims.

I claim:

1. An improvement in a turning mechanism of a lock, comprising in combination, a turning mechanism housing means, a spindle means, a lever means, a locking rod means, a retractor housing means, a retractor means, a spring means, and a latch bolt mechanism member means; with the turning mechanism housing means having handle means which turn in any direction and having a locking assembly means therein and therebetween said turning mechanism housing means containing therein a spindle means, which spindle means moves with the handle means, said spindle means to utilize in part an area proximate to the turning mechanism housing means and contained therein, said spindle means shaped to be arched in an inner large portion, said arched portion adjoined at its side edges with plates relatively perpendicular to it, which said plates are adjoined to other smaller arched portions relatively perpendicular to the said side edge plates, which said other arched portions engage with the handle means; a lever means moving on suitable means attached to the turning mechanism housing means, with the said movement located in the upper section of the lever means, said lever means of proper length for engagement with the retractor means, with activation of the lever means caused by rotation of the spindle means, whereby a rotation of the spindle means turns a lever means, and an opposite rotation of the spindle means turns another lever means, thereby the lever means not associated to the rotation of the spindle means turns from engagement with the retractor means; a locking rod means which is activated by the locking means within and between the handle means, said locking rod means having the general contour of the spindle means such that the rod has straight portions from the handle means and a U-shaped portion therebetween, thereby mating with the U-shaped portion of the spindle means; a retractor housing means and a retractor means, with said retractor means encased and moving back and forth in the retractor housing means, said movement occurring from lever means engagement with the retractor means within the retractor housing means, whereby when the spindle means activates the lever means, movement of the retractor means is inward, when the lever means is not activated, a spring means in the housing means behind the retractor means pushes the retractor means forward, with the said retractor housing means aligning the movement of the retractor means, with attachment of the retractor housing means to the turning mechanism housing means by fastening means, said retractor housing means having openings to correlate to the passage and the movement of the lever means with the retractor means, with the spring means positioned in the retractor housing means pushing the retractor forward; a latch bolt mechanism member means which passes through an opening in the turning mechanism housing means and into an open end of the retractor housing means to engagement with the retractor means; therefore, through the composition and the combination of these elements of the turning mechanism and the element of the latch bolt mechanism, said turning mechanism is able to allow a latch bolt great movement, because an ability of the retractor means attached to the latch bolt member means utilizes the central area of the turning mechanism housing means.

2. A turning mechanism of a lock as in claim 1, whereby the locking rod means is in a position between the handle means, whereby a lever means is dogged causing the latch bolt to be dogged, thereby the retraction of a latch bolt of a lock in a locked position is unobtainable.

* * * * *